US012454808B2

(12) United States Patent
Davis et al.

(10) Patent No.: US 12,454,808 B2
(45) Date of Patent: Oct. 28, 2025

(54) ROTARY DITCHING ATTACHMENT FOR A TOOL MANIPULATING ARM

(71) Applicant: Herzog Railroad Services, Inc., St. Joseph, MO (US)

(72) Inventors: Timothy D. Davis, St. Joseph, MO (US); Tyler Austin Mejia, St. Joseph, MO (US); Steven R. Walton, Olathe, KS (US); Tony Shirk, Clarksdale, MO (US); Jacob D. Herzog, St. Joseph, MO (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 648 days.

(21) Appl. No.: 17/823,872

(22) Filed: Aug. 31, 2022

(65) Prior Publication Data

US 2023/0122672 A1 Apr. 20, 2023

Related U.S. Application Data

(60) Provisional application No. 63/256,063, filed on Oct. 15, 2021.

(51) Int. Cl.
*E02F 5/08* (2006.01)
*E02F 5/14* (2006.01)

(52) U.S. Cl.
CPC . *E02F 5/08* (2013.01); *E02F 5/14* (2013.01)

(58) Field of Classification Search
CPC ..... E02F 5/02; E02F 5/08; E02F 5/14; E02F 5/145
See application file for complete search history.

(56) References Cited

U.S. PATENT DOCUMENTS

| | | | |
|---|---|---|---|
| 706,175 | A | 8/1902 | Hanneborg |
| 720,841 | A | 2/1903 | Pawel |
| 880,826 | A | 3/1908 | Reistad |
| 2,969,601 | A | 1/1961 | McMaster |
| 3,104,481 | A | 9/1963 | George et al. |

(Continued)

FOREIGN PATENT DOCUMENTS

| | | | |
|---|---|---|---|
| CN | 112523291 | A | 3/2021 |
| CZ | 2015481 | A3 | 1/2017 |

(Continued)

*Primary Examiner* — Tara Mayo
(74) *Attorney, Agent, or Firm* — AVEK IP, LLC; Kent R. Erickson

(57) ABSTRACT

A rotary ditching attachment for an articulated boom of an excavator type machine includes two rotary excavating heads supported in spaced relation on opposite sides of a central support. The heads rotate about a common axis. The rotary ditching attachment is rotatably coupled to the boom by a rotating tool mount. The rotating tool mount is connectable to the central support such that the central support and attached excavating heads are rotatable about an axis extending through the central support and perpendicular to the common axis of the excavator heads. Excavating assemblies are mounted on outwardly facing and inwardly facing surfaces of rotors forming each excavating heads. Rotating the rotary ditching attachment relative to a direction of movement of the rotary ditching tool relative to the ground increases the width of cut of the excavating heads when used to form or rehabilitate a ditch.

22 Claims, 11 Drawing Sheets

(56) References Cited

U.S. PATENT DOCUMENTS

| | | | | |
|---|---|---|---|---|
| 3,967,396 | A | 7/1976 | Maisonneuve et al. | |
| 4,459,767 | A | 7/1984 | Cartner | |
| 4,542,940 | A * | 9/1985 | Marten | E02F 3/303 173/8 |
| 4,612,715 | A | 9/1986 | Cartner | |
| 4,712,320 | A * | 12/1987 | Cartner | E02F 3/20 37/189 |
| 4,713,898 | A | 12/1987 | Bull et al. | |
| 4,736,534 | A | 4/1988 | Daniels et al. | |
| 5,027,534 | A | 7/1991 | Sackett | |
| 5,315,770 | A | 5/1994 | Campbell | |
| 6,085,446 | A | 7/2000 | Posch | |
| 6,336,280 | B1 | 1/2002 | Haigh | |
| 6,438,874 | B1 | 8/2002 | LaBounty et al. | |
| 6,561,742 | B1 | 5/2003 | Crawford et al. | |
| 7,604,301 | B1 * | 10/2009 | Lang | E02F 3/205 299/68 |
| 9,739,033 | B2 | 8/2017 | Thompson | |
| 2018/0010319 | A1 | 1/2018 | Fisher | |

FOREIGN PATENT DOCUMENTS

| | | | |
|---|---|---|---|
| EP | 2213793 | B1 | 8/2017 |
| FR | 3006276 | A1 | 12/2014 |
| SU | 1465507 | A1 | 3/1989 |

* cited by examiner

ROTARY DITCHING ATTACHMENT FOR A TOOL MANIPULATING ARM

CROSS-REFERENCE TO RELATED APPLICATIONS

This application claims priority to U.S. Provisional Application Ser. No. 63/256,063, filed Oct. 15, 2021, and titled "Rotary Ditching Attachment for a Tool Manipulating Arm", the disclosure of which is hereby incorporated herein in its entirety by reference.

BACKGROUND OF THE INVENTION

Field of the Invention

This invention relates to rotary ditching attachments for a boom or articulated arm such as the boom of an excavator type machine including excavator type machines mounted on an undercarriage adapted to travel along the tops of the sidewalls of open top railroad cars.

Description of the Related Art

Ditches are created along the sides of road or railroad track beds to improve the drainage of water away from the road or track beds. Over time sediment accumulates in the ditches and ballast forming railroad track beds migrates downward into ditches along railroad tracks which can impede the draining of water away from the road or railroad track bed. In addition, vegetation growing in the ditches also impedes the draining of water away from the bed.

It is known to mount a rotating disc, driven by a hydraulic motor, on a boom or articulated arm of an excavator type machine. U.S. Pat. No. 9,739,033 of Thompson discloses a rotary ditcher attachment for an excavator in which a rotating disc, with blades mounted on both sides of the disc, is removably couplable to the bottom of a tool mount of a boom of the excavator. U.S. Pat. No. 6,336,280 of Haigh discloses a self-propelled rotary excavator with a rotating cutting device attached to the end of a boom assembly. The rotating cutting device comprises a disc with cutting blades projecting outward from the disc. The rotating cutting heads or discs disclosed by Thompson and Haigh are oriented with the rotational axis of the disc extending in the direction of the ditch to be formed or of an existing ditch from which sediment, ballast or vegetation needs to be removed. Existing rotary ditching attachments for excavators are limited in the size of the ditch that can be formed or cleared by the diameter of the rotating cutting head.

There remains a need for a rotary ditching tool that can be attached to a boom or articulated arm of an excavator type implement in a manner which facilitates varying the width of a ditch cut or cleaned out by the tool.

SUMMARY OF THE INVENTION

The present is directed to a rotary ditcher such as a rotary ditching attachment for a manipulating arm such as an articulated boom of an excavator type machine. The rotary ditcher is particularly well adapted for forming or rehabilitating ditches extending along railroads or other roads. In one embodiment for use in forming or rehabilitating ditches along railroads the machine to which the rotary ditcher is attached is adapted to be supported on and preferably travel longitudinally across the top of open top rail cars.

The rotary ditching attachment includes two rotary excavating heads supported in spaced relation on a central frame and which rotate about a common axis or offset axes. The rotary ditching attachment may be rotatably coupled to the arm or boom of the excavator by a rotating tool mount. The rotating tool mount is connectable to the central frame such that the central frame and attached excavating heads are rotatable about an axis extending through the central frame. Excavating assemblies are formed on outwardly facing and inwardly facing surfaces of rotors forming each rotary excavating heads. Rotating the rotary ditching attachment relative to the arm or boom and a direction of movement of the rotary ditching tool relative to the ground to form or rehabilitate a ditch, increases the width of cut of the excavating heads.

DETAILED DESCRIPTION OF THE PREFERRED EMBODIMENTS

Figure 1:
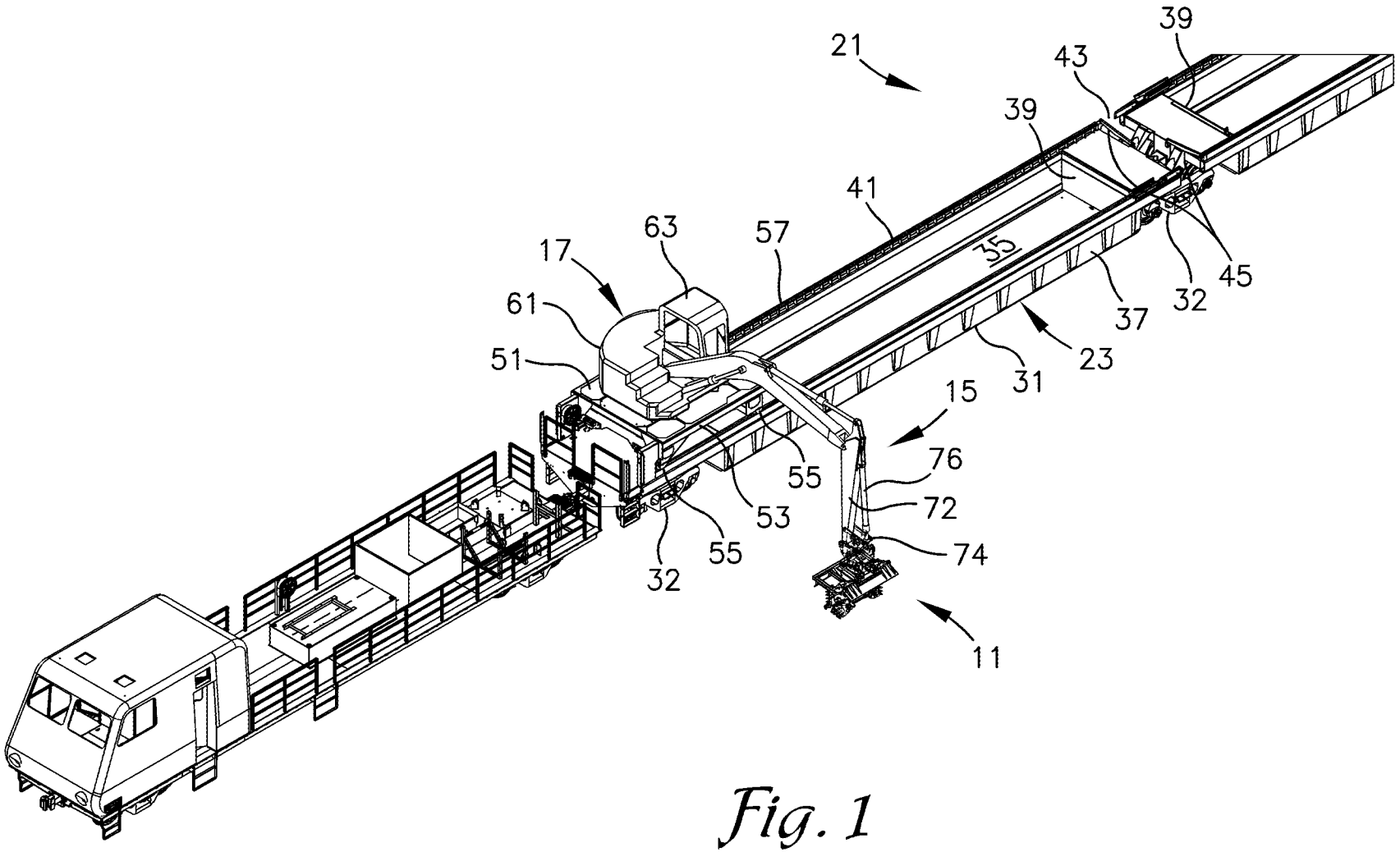
FIG. 1 is a fragmentary perspective view of a consist of open top rail cars with an excavator adapted for traversing the tops of the open top rail cars and having a rotary ditching tool attached to a boom of the excavator by a rotating tool mount.
Figure 2:
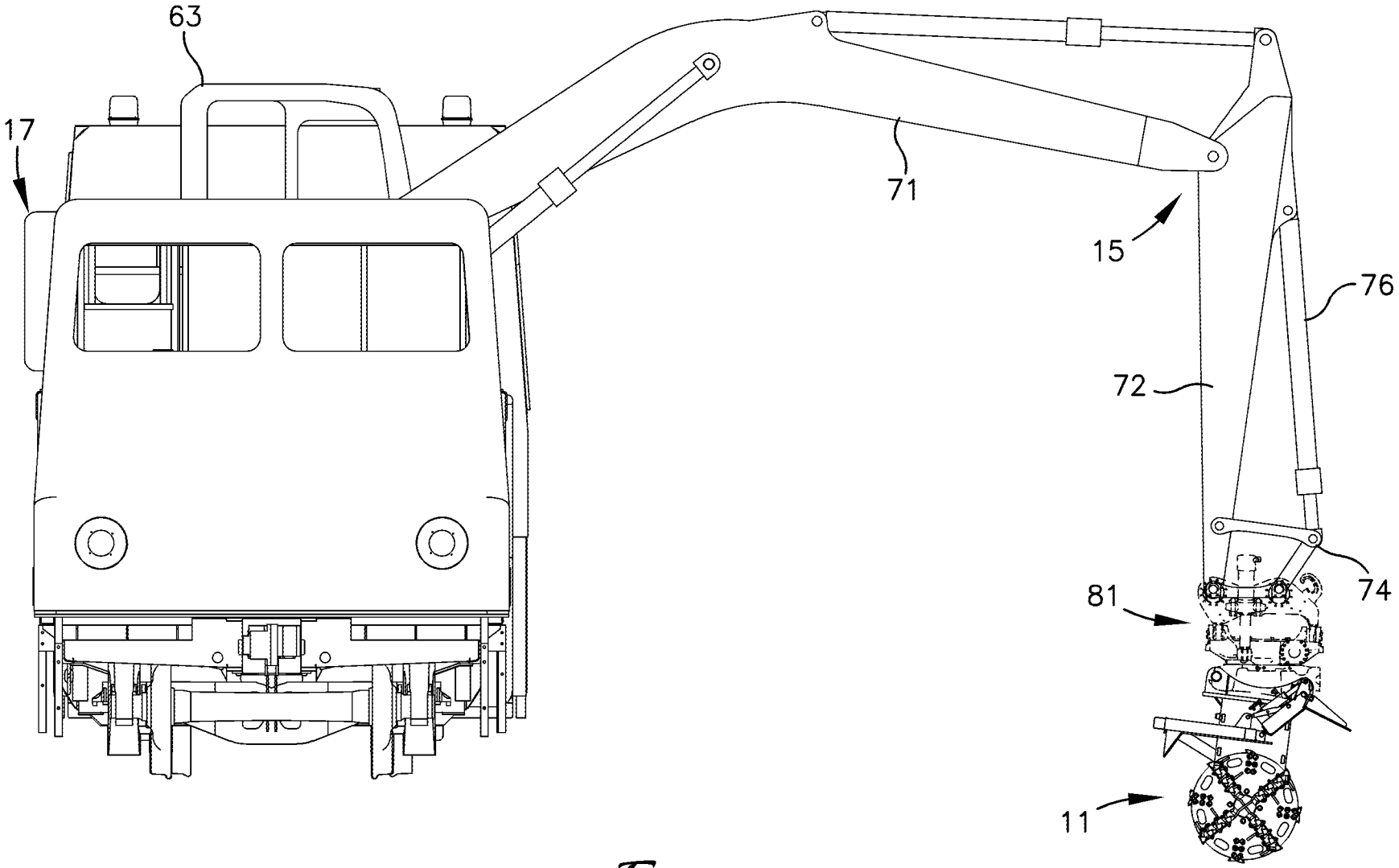
FIG. 2 is a front view of the consist of open top rail cars with the excavator supported thereon and the rotary ditching tool attached to the excavator boom by the rotating tool mount.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings, a rotary ditching tool 11 is shown as an attachment for an articulated arm or boom 15 of an excavator type machine 17 which may also be referred to as a material handling machine 17. The excavator 17 may be adapted for traversing the tops of a consist 21 of open top rail cars or well cars 23 when the ditching tool 11 is used for creating or rehabilitating ditches 25 along the bed of a railroad track. It is foreseen that the rotary ditching tool 11 may be mounted on other types of tool manipulating arms and tool manipulating equipment other than the articulated arm 15 of an excavator type machine 17.

Referring to FIG. 1, the well cars 23 shown in the drawings each comprise a car body 31 supported on trucks 32. The car body 31 includes a floor or bottom 35, sidewalls 37 and end walls 39 substantially enclosing a space 40 for receiving material. The excavator 17 shown has been modified to travel on upper ends or tops 41 of the sidewalls 37 of the car body 31 and across a gap 43 between end walls 39 of adjacent well cars 23 as shown in FIG. 1 which may be spanned by bridges 45. The excavator 17 includes a trolley, gantry or undercarriage 51 comprising a platform or central fame 53 mounted or supported on flanged wheels 55 which ride or travel on rails 57 incorporated into the tops 41 of the well car sidewalls 37. It is foreseen that the central frame 53 of the undercarriage 51 could be supported on rolling supports other than flanged wheels 55, such as for example a pair of continuous tracks for a tracked type vehicle with guide members to prevent the tracks from advancing off of the sidewalls 37.

The excavator further comprises a power and control unit 61, which may include a cab 63 which is rotatably mounted on a turntable (not shown) on the undercarriage 51 to permit the power and control unit 61 to rotate 360 degrees relative to the undercarriage 51. The articulated arm or boom 15 is connected to and its operation is controlled through the power and control unit 61. The boom 15 shown is formed from inner and outer boom or arm segments 71 and 72. Inner boom segment 71 is pivotally connected at a first end to the power and control unit 61 and at a distal end to an inner end of the outer boom segment 72.

A pivot assembly 74 is connected to the outer boom segment 72 proximate a distal end thereof. Movement of the pivot assembly 74 is imparted by actuator 76 connected between the outer boom segment 72 and pivot assembly 74. Pin receivers (not shown) are formed in the distal end of the outer boom segment 72 and the pivot assembly 74 to receive pins mounted on an attachment to be connected to the boom 15.

Figure 3:
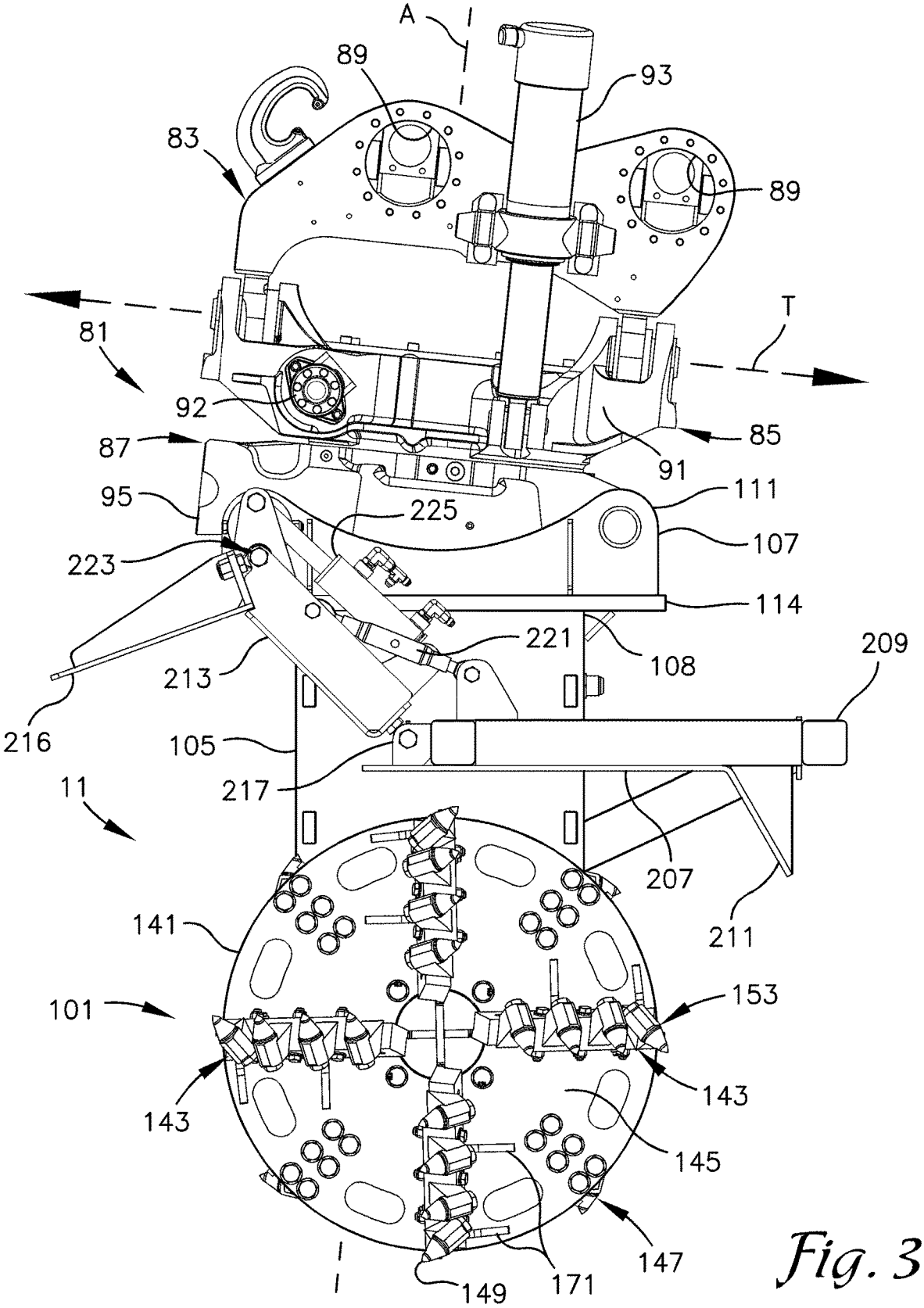
FIG. 3 is a greatly enlarged end view of the rotary ditching tool and rotating tool mount separated from the excavator boom.
Figure 5:
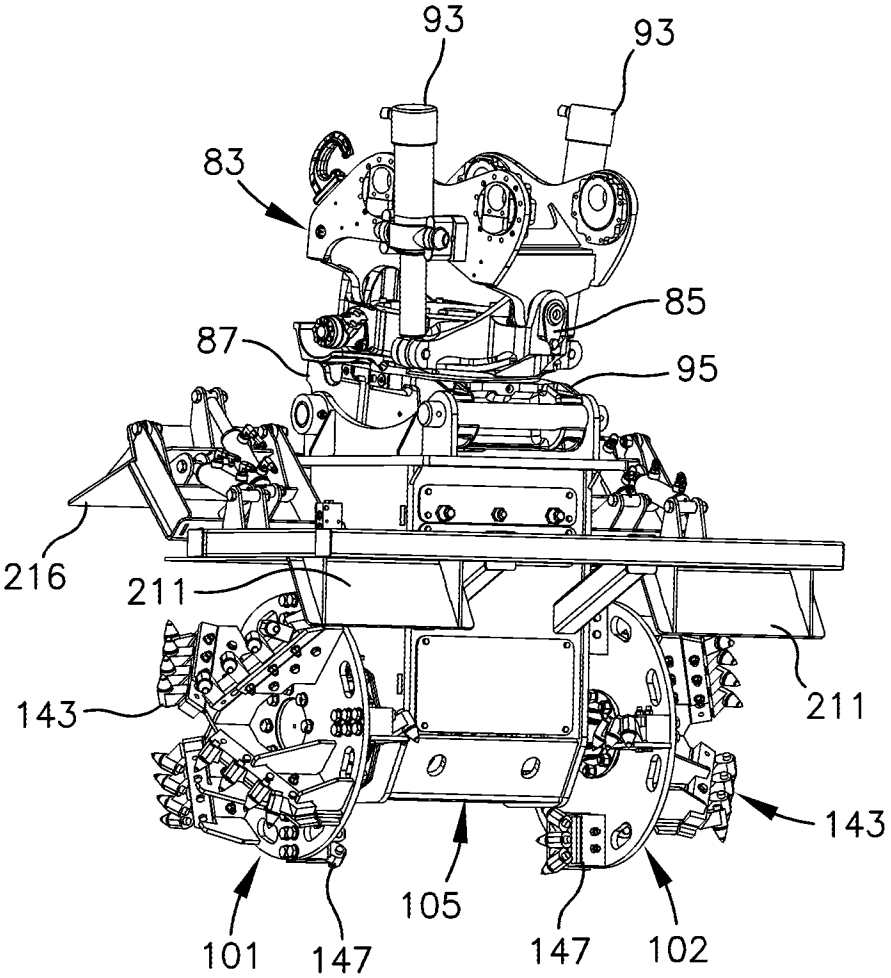
FIG. 5 is a perspective view of the rotary ditching tool rotated relative to the rotating tool mount as in FIG. 4.
Figure 4:
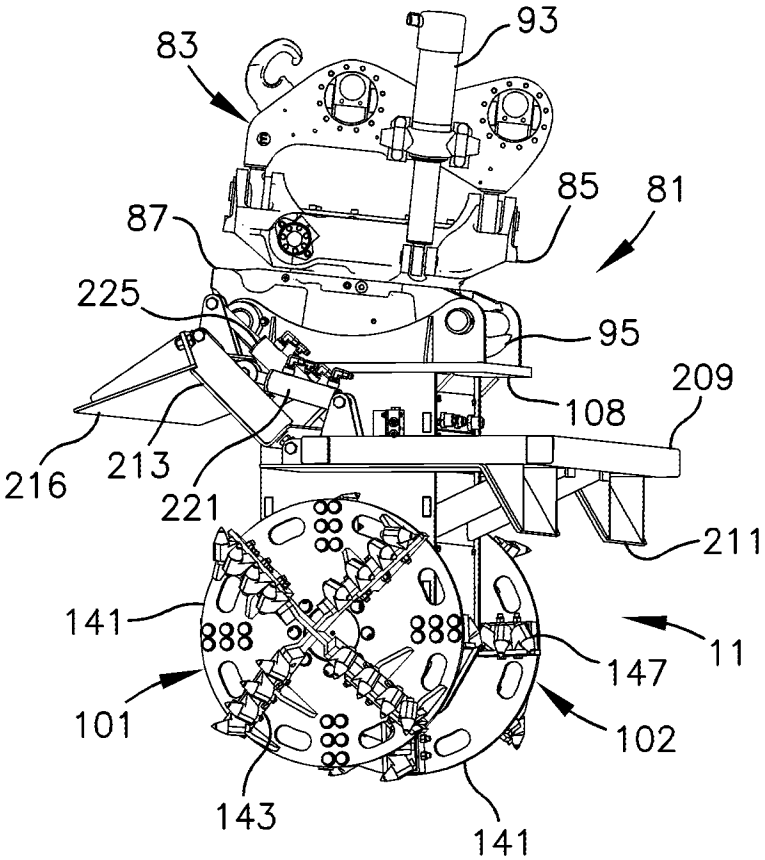
FIG. 4 is a view similar to FIG. 3 showing the rotary ditching tool rotated by the rotating tool mount relative to the orientation in FIG. 3.
Figure 6:
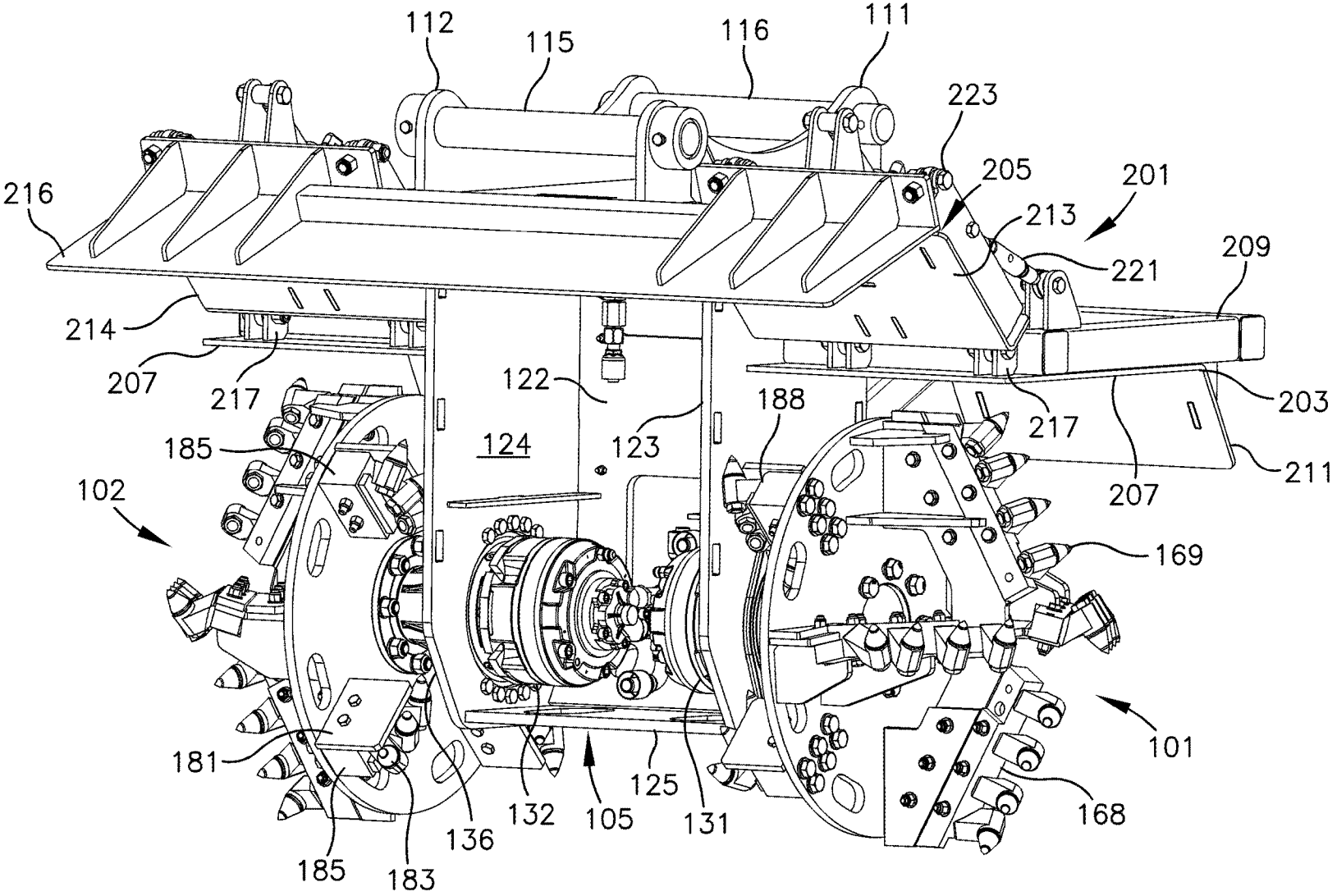
FIG. 6 is a front, perspective view of the rotary ditching tool with portions of a central frame removed to show interior detail.
Figure 7:
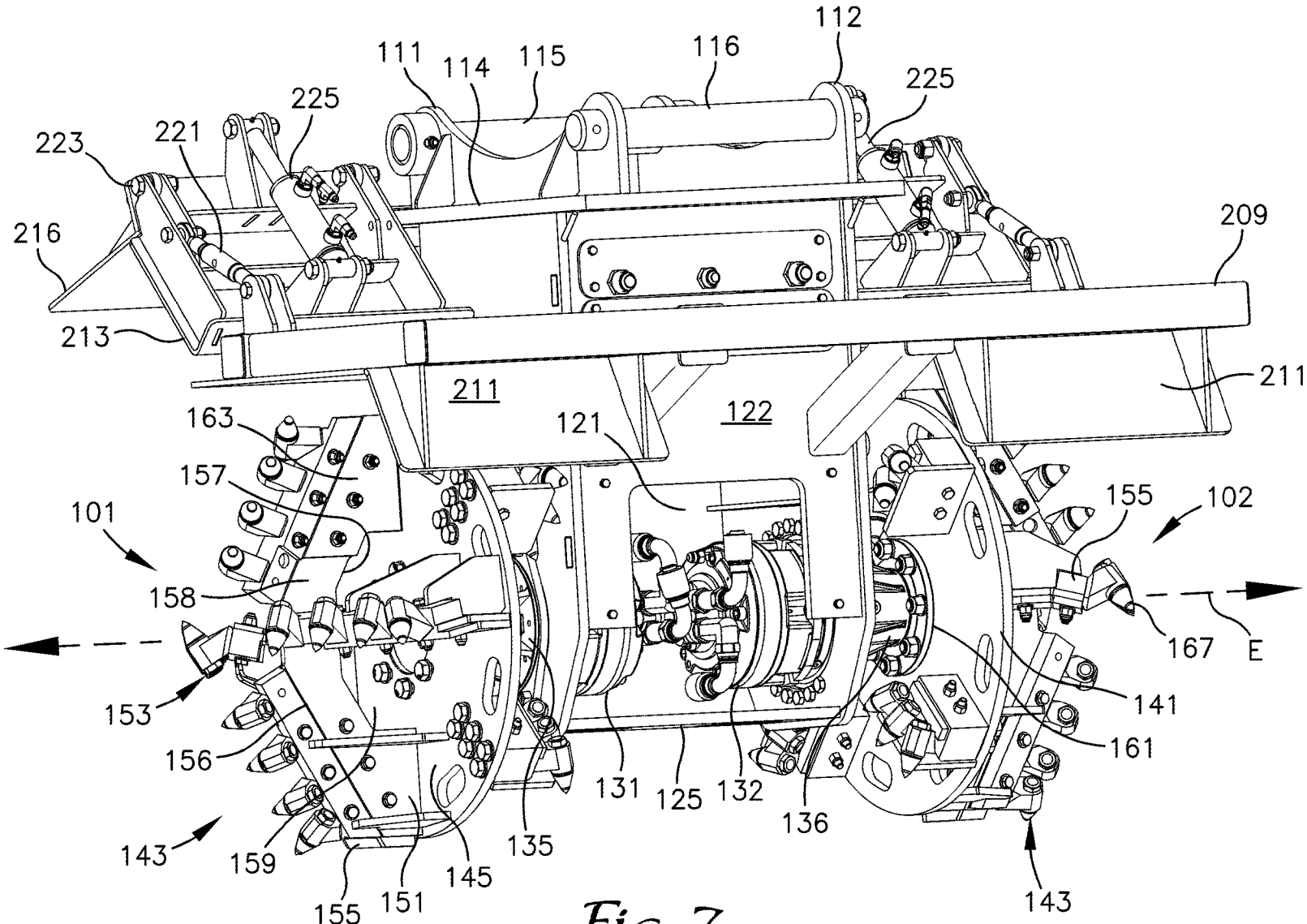
FIG. 7 is a rear perspective view of the rotary ditching tool with portions of the central frame removed to show interior detail thereof.

In the embodiment shown in FIGS. 1-5, a rotating tool mount 81 is connected between the distal end of the outer boom segment 72 and the rotary ditching tool 11. The rotating tool mount 81 shown may be of the type sold by Rototilt, Inc. under the ROTOTILT brand. Referring to FIGS. 3 through 5, the rotating tool mount 81 includes an upper mounting section 83, an intermediate rotating section 85 and a lower mounting section 87. The upper mounting section 83 may be secured directly to the distal end of the outer boom segment 72 and the pivot assembly 74 using pins (not shown) inserted through pin receivers 89 in the upper mounting section 83 aligned with pin receivers in the outer boom segment 72 and pivot assembly 74. Alternatively, a quick coupler (not shown) connected to the end of the outer boom segment 72 and the pivot assembly 74 may be used to releasably connect the upper mounting section 83 of the rotating tool mount 81 to the boom 15. In the embodiment shown, a body or housing 91 of the intermediate rotating section 85 of the tool mount 81 is pivotally connected to the upper mounting section 83 to allow side to side pivoting of intermediate rotating section 85 relative to the upper mounting section 83 about tilt axis T. One or more linear actuators 93 connected between the upper mounting section 83 and the intermediate rotating section 85 are operable to pivot the intermediate rotating section 85 relative to the upper mounting section 83 to permit tilting of the rotary ditching tool 11 relative to the boom 15.

The intermediate rotating section 85 includes a rotating bearing (not shown), rotatably mounted within the body 91 and which is rotated by a worm gear (not shown) driven by a hydraulic motor 92 supported on the body 91. The lower mounting section 87 is fixedly secured to the rotating bearing to rotate therewith and relative to the body 91 of the intermediate rotating section 85 about an attachment axis of rotation A. The lower mounting section 87 shown incorporates a quick connect coupler 95 operable for remotely and releasably coupling the rotating tool mount 81 to the rotary ditching tool 11. The hydraulic motor for actuating or driving the tilt actuators 93, the worm gear of the intermediate rotating section 85 and the coupling mechanism of quick connect coupler 95 are hydraulically operated or driven with hydraulic fluid supplied from the power and control unit 61 of the excavator 17 through hoses not shown.

The rotating ditching tool 11 includes first and second cutting heads or excavating heads 101 and 102 rotatably mounted on opposite sides of a central frame or central support 105. An attachment feature or attachment structure 107 is connected to an upper end 108 of the central frame 105. In the embodiment shown, the attachment feature 107 comprises first and second pin supports 111 and 112 projecting upward from a mounting plate 114 or mounting structure 114 in spaced apart relationship. Two coupling pins 115 and 116 are secured to and extend between the pin supports 111 and 112 in parallel spaced relation. The coupling pins 115 and 116 are sized and spaced apart to be releasably engageable by the quick connect coupler 95 on the lower mounting section 87 of the rotating tool mount 81.

In the embodiment shown, the central frame 105 is formed as a rectangular housing with front and rear panels 121 and 122 and first and second sidewalls 123 and 124 depending from the mounting plate 114 in spaced apart relationship and floor panels 125 extending across lower ends of the first and second sidewalls 123 and 124 and between the front and rear panels 121 and 122. Access panels may be secured over openings in the central frame 105 to provide access to the interior thereof.

First and second motors 131 and 132 are mounted to the sidewalls 123 and 124 respectively proximate lower ends thereof for rotatingly driving the first and second excavating heads 101 and 102. First and second drive shafts 135 and 136 project form the first and second motors 131 and 132 respectively and through openings in the sidewalls 123 and 124 and are connected to the first and second excavating heads 101 and 102 respectively. In the embodiment shown, the axes of rotation E of the drive shafts 135 and 136 and the excavating heads 101 and 102 are axially aligned. It is foreseen that the axes of rotation E of the drive shafts 135 and 136 and the excavating heads 101 and 102 could extend in parallel spaced relation including a spaced relationship with one axis extending forward of or closer to the front panel 121 than the other axis.

With reference to FIGS. 6 through 9, each of the excavating heads 101 and 102 comprises a rotor 141 fixedly coupled to a respective drive shaft 135 and 136 in axial alignment about a common, excavating head axis of rotation E. In the embodiment shown, each rotor is formed as a flat disc. It is foreseen that the rotors 141 could be conical or frusto-conical. A plurality of outwardly projecting excavating assemblies 143 project outward from an outer face 145 of each rotor 141 and extend radially outward from the center of the rotor 141 or at least partially across the outer face 145. A plurality of inwardly projecting excavating assemblies 147 project inward from an inner face 149 of each rotor 141 and extend radially outward from the center of the rotor 141. In the embodiment shown, four outwardly projecting excavating assemblies 143 and four inwardly projecting excavating assemblies are secured to each rotor 141 and are arcuately spaced approximately ninety degrees apart. In the embodiment shown, the outwardly projecting excavating assemblies 143 slope rearward as they extend radially outward from a center of the rotor 141 to generally form a conical cutting or excavating face. As used in describing the excavating heads 101 and 102, directional references of forward and rearward or outward and inward are made relative to the central frame 105 being in the center of the assembly.

Each outwardly projecting excavating assembly 143 includes a base plate 151 connected to the outer face 145 of the rotor 141 and a plurality of radially spaced cutting bit assemblies 153 secured to a bit mounting block 155 connected to the base plate 151. Each base plate 151 is welded or otherwise secured to the rotor 141 and projects forwardly therefrom. In the embodiment shown, each base plate 151 projects perpendicular to and outward from the outer face of the rotor 141. Diametrically aligned base plates 151 may be formed as a single piece. In the embodiment shown, an outer edge 156 of each base plate 151 slopes rearward from the center of the rotor 141 as it extends radially outward toward an outer edge of the rotor 141. An inner edge 157 of an inner end 158 of each base plate 151 may be spaced outward from the outer face 145 of the rotor 141 to form a gap 159 extending over a central section 161 of the rotor 141 to which the axle or drive shaft 135 or 136 respectively may be bolted. The gap 159 spaced between the rotor 141 and the inner end 158 of each base plate 151 allows easier access to the bolts for securing the rotor 141 to the shaft 135 or 136. A wear plate 163, of hardened metal or other material, may be bolted or otherwise removably secured to a leading face of each base plate 151 on the outwardly projecting excavating assembly 143. As used herein, the leading face of each base plate 151 is the face facing the direction of rotation of the base plate 151.

Each bit mounting block 155 is connected to or secured to a corresponding base plate 151 and extends in radially outward extending alignment therewith to position the cutting bit assemblies 153 connected thereto along and outward from the respective base plate 151. In the embodiment shown, four cutting bit assemblies 153 are connected to each bit mounting block 155 but it is understood that number could vary. Each cutting bit assembly 153 includes a base 165 and an excavating or digging bit 167 which may also be referred to as a pick 167. Each base 165 is welded or otherwise secured to the bit mounting block 155 across an outwardly oriented face 168 or surface thereof in a desired spacing and orientation to position and orient the excavating bits 167 mounted thereon in a desired orientation for excavating or cleaning out a ditch. Each bit 167 or selected bits 167 may be rotatably mounted relative to the base 165 to which the bit 167 is attached. The spacing of the bit assemblies 153 shown is generally radially aligned relative to the bit assemblies 153 on adjacent outwardly projecting excavating assembly 143 so that the path of rotation of the bits on adjacent excavating assemblies 143 is radially aligned. It is foreseen that the spacing of the bit assemblies 153 on adjacent outwardly projecting excavating assemblies 143 may be radially offset so that the path of rotation of the bits on adjacent excavating assemblies 143 are radially offset and do not overlap. The angular orientation of each bit 167 relative to its respective base 165 may be varied so that the angular orientation of a tip 169 of each bit 167 is varied to provide different angles of attack of the bits into or against the material to be removed to form or clean out a ditch. It is also foreseen, that the number of cutting bit assemblies 153 incorporated into each excavating assembly 143 could vary on each excavating head 101 and 102. For example, a first set of diametrically aligned excavating assemblies 143 might each include four cutting bit assemblies 153 mounted thereon and the second set of diametrically aligned excavating assemblies 143 might each include three cutting bit assemblies 153 mounted thereon with the cutting bit assemblies 153 of adjacent excavating assemblies radially offset to circumscribe different paths of rotation.

In the embodiment shown, each bit mounting block 155 and the outwardly oriented face 168 thereof slopes rearward and radially outward from the center of the rotor 141 with the position of the tips 169 of each successive excavating bit 167 sloping rearward from the center of the rotor 141 to generally form a conical cutting face on each excavating head 102. The slope of the conical cutting face could vary and the outer edge 156 of each base plate 151 and the outer face 168 of each bit mounting block 155 and a line across the tips 169 of the bits 167 mounted thereon could extend parallel to the outer face 145 of the rotor 141 and generally transverse to or perpendicular to the axis of rotation of the rotor 141 or excavating head 102.

Gussets 171 are shown welded to and between the outer face 145 of the rotor 141 and trailing faces of each base plate 151 and bit mounting block 155 of each outwardly projecting excavating assembly 143. A wear plate 173, formed from hardened metal or other hardened material, may be removably secured to a leading face of each bit mounting block 155. The base plate 151 and bit mounting block 155 of each excavating assembly 143 function as blades or paddles to engage material loosened by the bits or picks 167 and throw the material outward and away from the rotating excavating head 101 or 102 to which it is attached.

Each inwardly projecting excavating assembly 147 includes a base plate 181 connected to and inner face 149 of the rotor 141 and a plurality of radially spaced cutting bit assemblies 183 secured to a bit mounting block 185 connected to the base plate 181. Each base plate 181 is welded or otherwise secured to the rotor 141 and projects rearwardly or inwardly therefrom. In the embodiment shown, each base plate 181 projects perpendicular to and inward from the inner face 149 of the rotor 141. Diametrically aligned base plates 181 are spaced apart across a center of the rotor 141 to accommodate the drive shaft 135 or 136 secured to rotor 141. In the embodiment shown, an outer edge 184 of each base plate 181 extends parallel to the inner face of the rotor 141 and transverse to the axis of rotation of the rotor 141. It is foreseen that the outer edge 184 could be sloped forwardly as the base plate 181 extends radially outward on the rotor 141. The base plate 181 may be formed of hardened metal or other material. As used herein, the leading face of each base plate 181 is the face facing the direction of rotation of the base plate 181.

In the embodiment shown, each bit mounting block 185 is connected to or secured to the inner face 149 of the rotor 141 and against a trailing face of each base plate 181. In the embodiment shown, three cutting bit assemblies 183 are connected to each bit mounting block 185 but it is understood that number could vary. Each cutting bit assembly 183 includes a base 186 and an excavating or digging bit 187 which may also be referred to as a pick 187. Each base 186 is welded or otherwise secured to the bit mounting block 185 across an outwardly oriented face 188 or surface thereof in a desired spacing and orientation to position and orient the excavating bits 187 mounted thereon in a desired orientation for excavating or cleaning out a ditch. Each bit 187 or selected bits 187 may be rotatably mounted relative to the base 186 to which the bit 187 is attached.

The spacing of the bit assemblies 183 shown is generally radially aligned relative to the bit assemblies 183 on adjacent inwardly projecting excavating assembly 147 so that the path of rotation of the bits 187 on adjacent excavating assemblies 147 is radially aligned. It is foreseen that the spacing of the bit assemblies 183 on adjacent inwardly projecting excavating assemblies 147 may be radially offset so that the path of rotation of the bits 187 on adjacent excavating assemblies 147 are radially offset and do not overlap. The angular orientation of each bit 187 relative to its respective base 186 may be varied so that the angular orientation of a tip 189 of each bit 187 is varied to provide different angles of attack of the bits 187 into or against the material to be removed to form or clean out a ditch. It is also foreseen, that the number of cutting bit assemblies 183 incorporated into each excavating assembly 147 could vary on each excavating head 101 and 102. For example, a first set of diametrically aligned excavating assemblies 147 might each include three cutting bit assemblies 183 mounted thereon and the second set of diametrically aligned excavating assemblies 183 might each include two cutting bit assemblies 183 mounted thereon with the cutting bit assemblies 183 of adjacent excavating assemblies 147 radially offset to circumscribe different paths of rotation.

Each base plate 181 extends further rearward from the inner face 149 of the rotor 141 than the associated bit mounting block 185 with the base 186 of each cutting bit assembly 183 extending generally behind a trailing face of the base plate 181 and the tip 189 extending over and past or rearward of base plate 181.

In the embodiment shown, the rear edge of each base plate 181, the outwardly oriented face 188 of each bit mounting block 185 and a line extending generally across the tips of the bits 187 extend parallel to the rear face of the rotor 141 and transverse to the axis of rotation of the rotor 141. It is foreseen that the rear edge of each base plate 181, the outwardly oriented face 188 of each bit mounting block 185 and a line extending generally across the tips of the bits 187 mounted on the bit mounting block 185 could slope from a high point closer to the center of the rotor and a low point proximate an outer edge of the rotor 141 to generally form a conical cutting face on a back side of each excavating head 102. The slope of the conical cutting face could vary.

Figure 10:
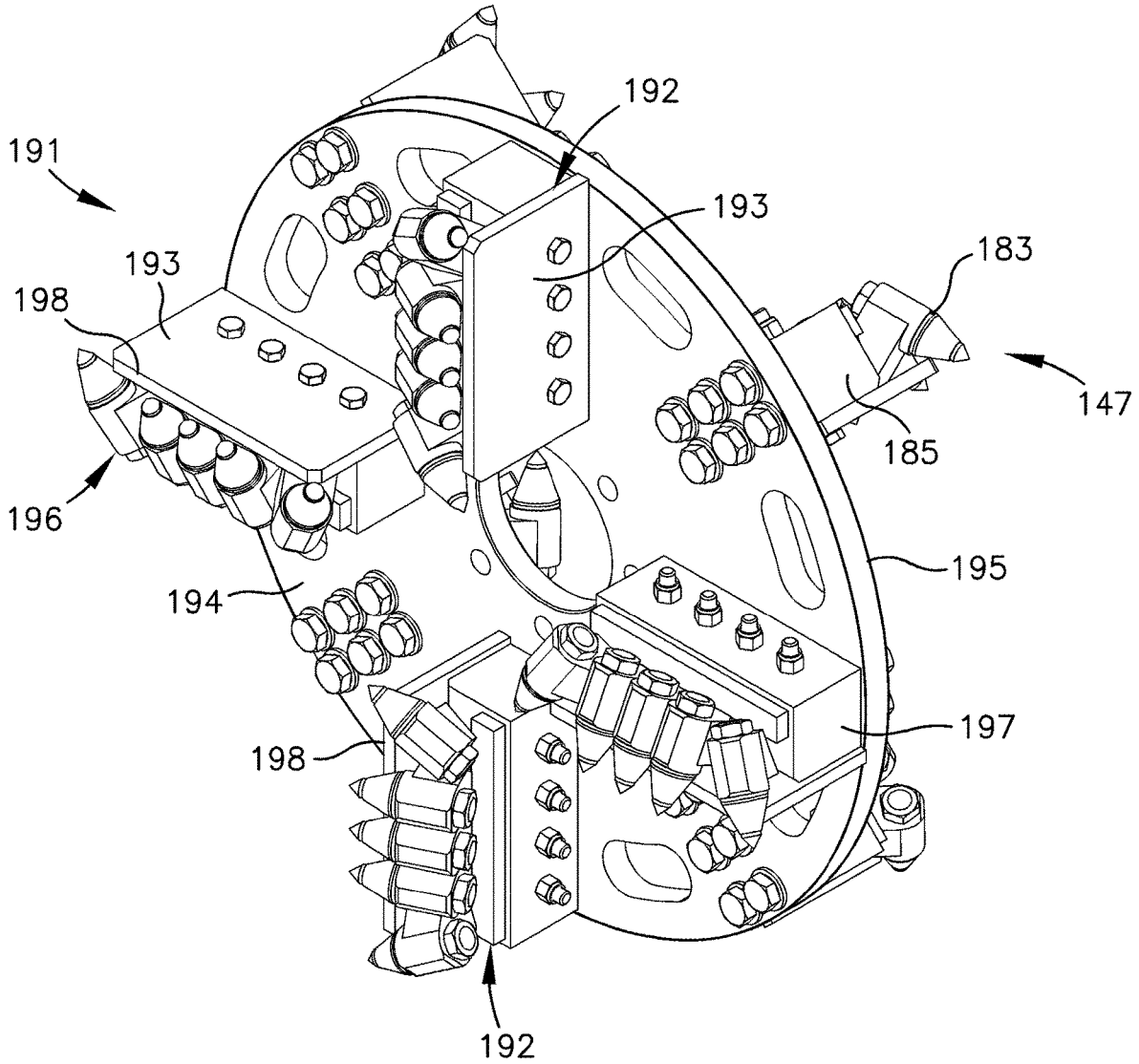
FIG. 10 is a front, perspective view of an alternative embodiment of an excavating head of the rotary ditching tool.

FIG. 10 shows an alternative embodiment of an excavating head 191 in which the outwardly projecting excavating assemblies 192 extend generally transverse to an axis of rotation of the excavating head 191 and are not sloped as with excavating heads 101 and 102. Each excavating assembly 192 on excavating head 191 includes a base plate 193 connected to an outer face 194 of a rotor 195 and a plurality of radially spaced cutting bit assemblies 196 secured to a bit mounting block 197 connected to the base plate 193. Each base plate 193 is welded or otherwise secured to the rotor 195 and projects forwardly or outwardly therefrom. In the embodiment shown, each base plate 193 projects perpendicular to and outward from the outer face 194 of the rotor 195. Diametrically aligned base plates 193 are spaced apart across a center of the rotor 195 to accommodate the drive shaft 135 or 136 secured to rotor 195. In the embodiment shown, an outer edge 198 of each base plate 193 extends parallel to the outer face 194 of the rotor 195 and transverse to the axis of rotation of the rotor 195. The base plate 193 may be formed of hardened metal or other material. As used herein, the leading face of each base plate 193 is the face facing the direction of rotation of the base plate 193.

Figure 8:
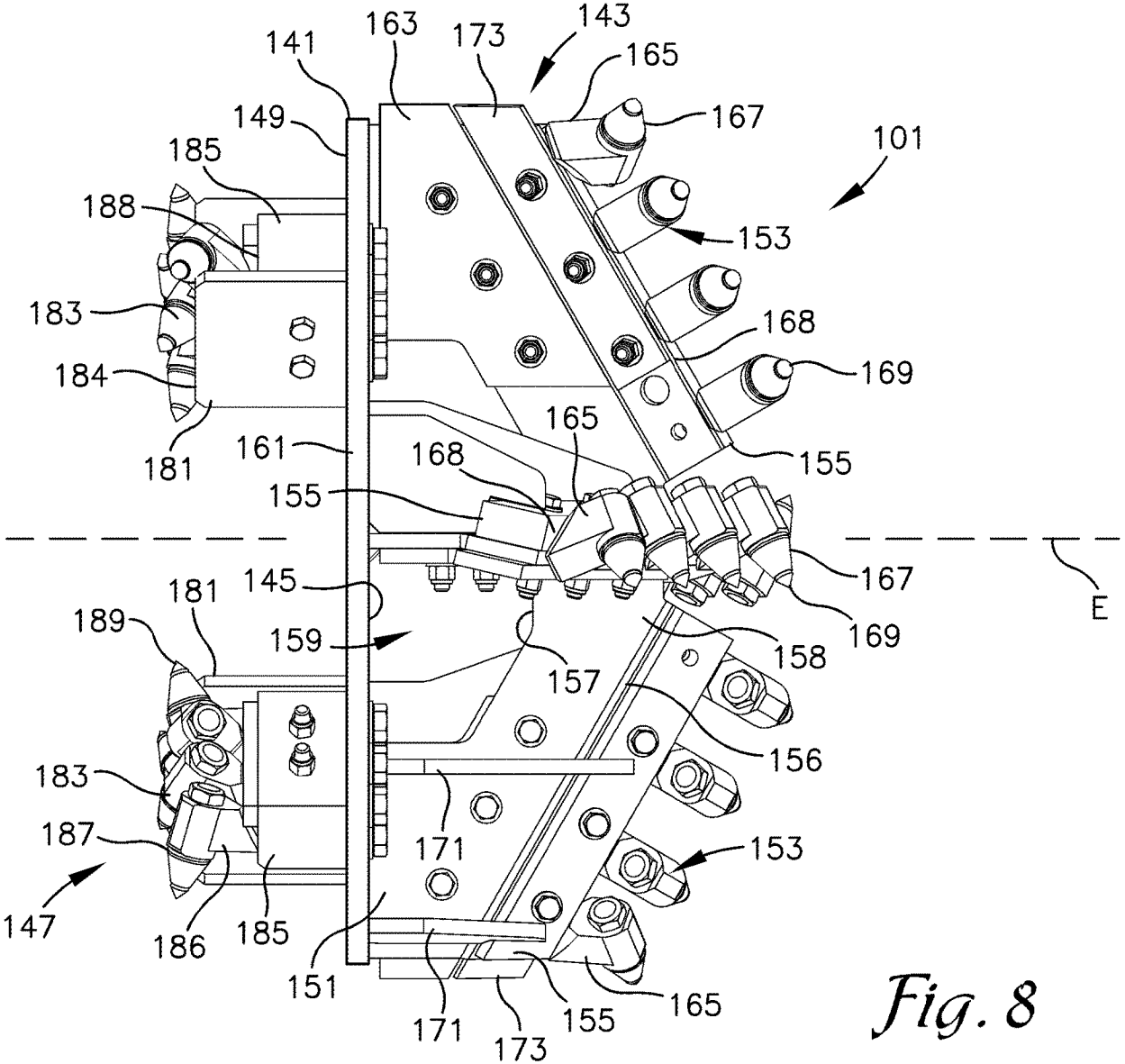
FIG. 8 is a front elevational view of an excavating head of the rotary ditching tool shown in FIGS. 1-7.
Figure 9:
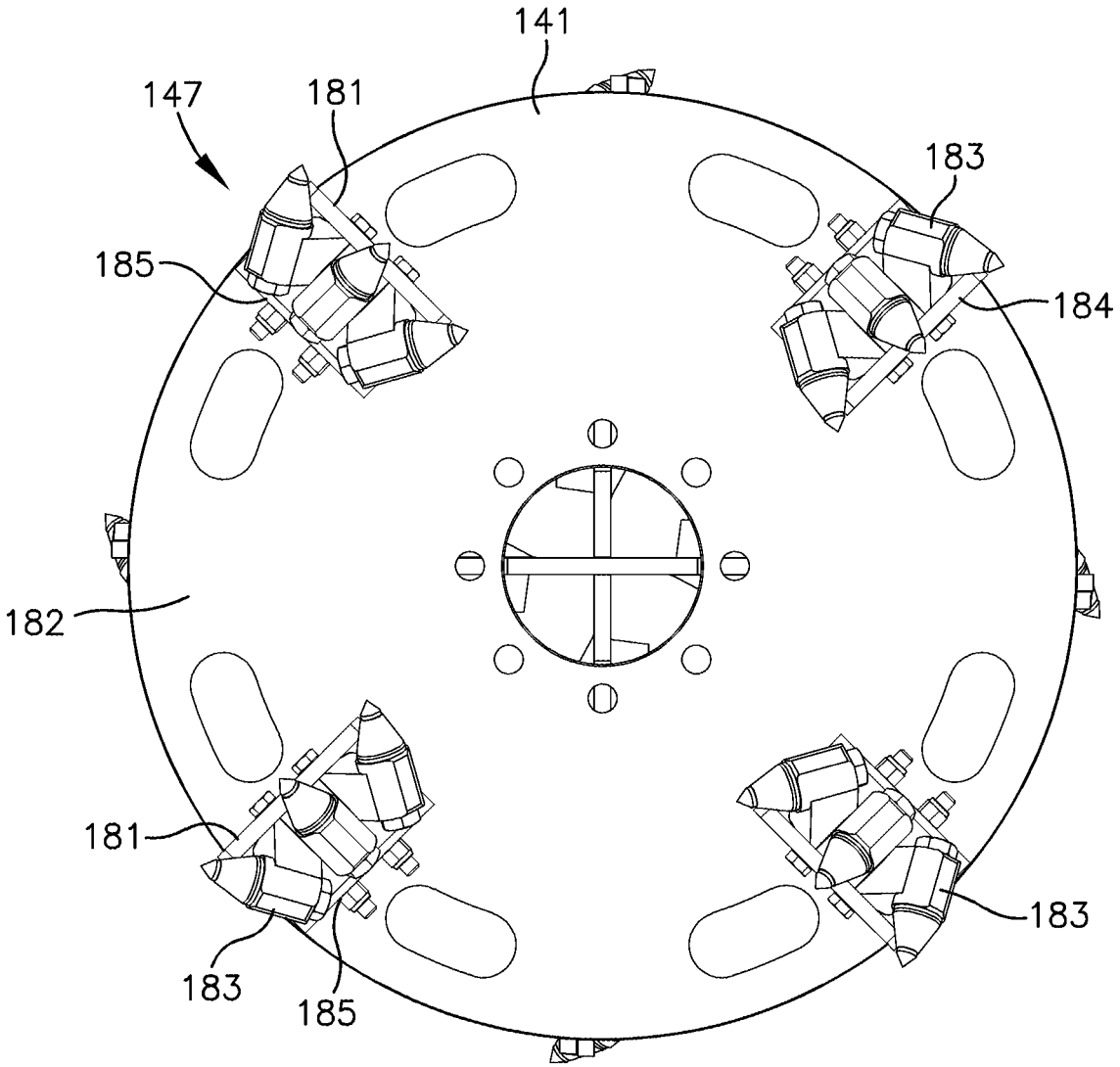
FIG. 9 is a rear elevational view of the excavating head as shown in FIG. 8.

In the embodiment shown, each bit mounting block 197 is connected to or secured to the outer face 194 of the rotor 195 and against a trailing face of each base plate 193. In the embodiment shown, five cutting bit assemblies 199 are connected to each bit mounting block 197 but it is understood that number could vary. The cutting bit assemblies 196 are constructed similar to and may be mounted similar to the cutting bit assembles 183 mounted on bit mounting blocks 185 on the inwardly projecting excavating assemblies 147 of first and second excavating heads 101 and 102 as shown in FIGS. 8 and 9.

The first and second motors 131 and 132 are wired to rotate in opposite directions, so that the first and second excavating heads rotate in the same direction when viewed from one end. For example, in the embodiment shown, the first and second excavating heads 101 and 102 rotate clockwise when looking toward the outer face 145 of rotor 141 of the first excavating head 101 and the first and second excavating heads 101 and 102 rotate counterclockwise when looking toward the outer face 145 of the rotor 141 of the second excavating head 102. A deflector assembly 201 is mounted on the central frame 105 above the excavating heads 101 and 102. The deflector assembly 201 includes a fixed deflector 203 and an articulated deflector 205. The fixed deflector 203 generally extends above the half of each excavating head 101 and 102 which rotates downward into the ground or ditch and the articulated deflector 205 generally extends above the half of each excavating head 101 and 102 which rotates upward out of the round or ditch.

The fixed deflector 203 includes a transverse panel 207 mounted on a deflector frame 209 and projecting outward from and transverse to the central frame 105 in spaced relation above the excavating heads 101 and 102. Angled panels 211 project downward at an acute angle from the transverse panel 207 proximate an outer edge thereof and on either side of the central frame 105 and in spaced relationship from the excavating heads 101 and 102. It is foreseen that the angled panels 211 could be formed as a single angled panel extending across the entire side of the rotary ditching tool 11.

The articulated deflector 205 comprises first and second inner pivoting panels 213 and 214 and an outer pivoting panel 216. The first and second inner pivoting panels 213 and 214 are pivotally connected by hinges 217 to the deflector frame 209 along an edge projecting outward from and transverse to the central frame 105. Actuators 221 connected between the deflector frame 209 and the first and second inner pivoting panels 213 and 214 are operable to pivot the first and second pivoting panels 213 and 214 relative to the deflector frame 209 and the excavating heads 101 and 102 respectively. Outer pivoting panel 216 is pivotally connected by hinges 223 along an inner edge thereof to the distal ends of the first and second inner pivoting panels 213 and 214. Actuators 225 connected between the first and second inner pivoting panels 213 and 214 and the outer pivoting panel 216 are operable to pivot the outer pivoting panel 216 relative to the first and second inner pivoting panels 213 and 214. The angular orientation of the first and second inner pivoting panels 213 and 214 relative to the deflector frame 209 and the first and second excavating heads 101 and 102 and the angular orientation of the outer pivoting panel 216 relative to the first and second inner pivoting panels 213 and 214 and relative to the first and second excavating heads 101 and 102 is adjustable using actuators 221 and 225 respectively to direct outward the material discharged by the portions of the excavating assemblies 143 and 147 rotating upwards toward the articulated deflector 205. As shown in FIG. 1, the rotary ditching tool 11 is preferably oriented relative to the excavator 17 or other machine to which it is attached so that the rotating excavating heads 101 and 102 rotate upward on the side of the tool 11 opposite the cab 63 to discharge material away from the operator.

Figure 11:
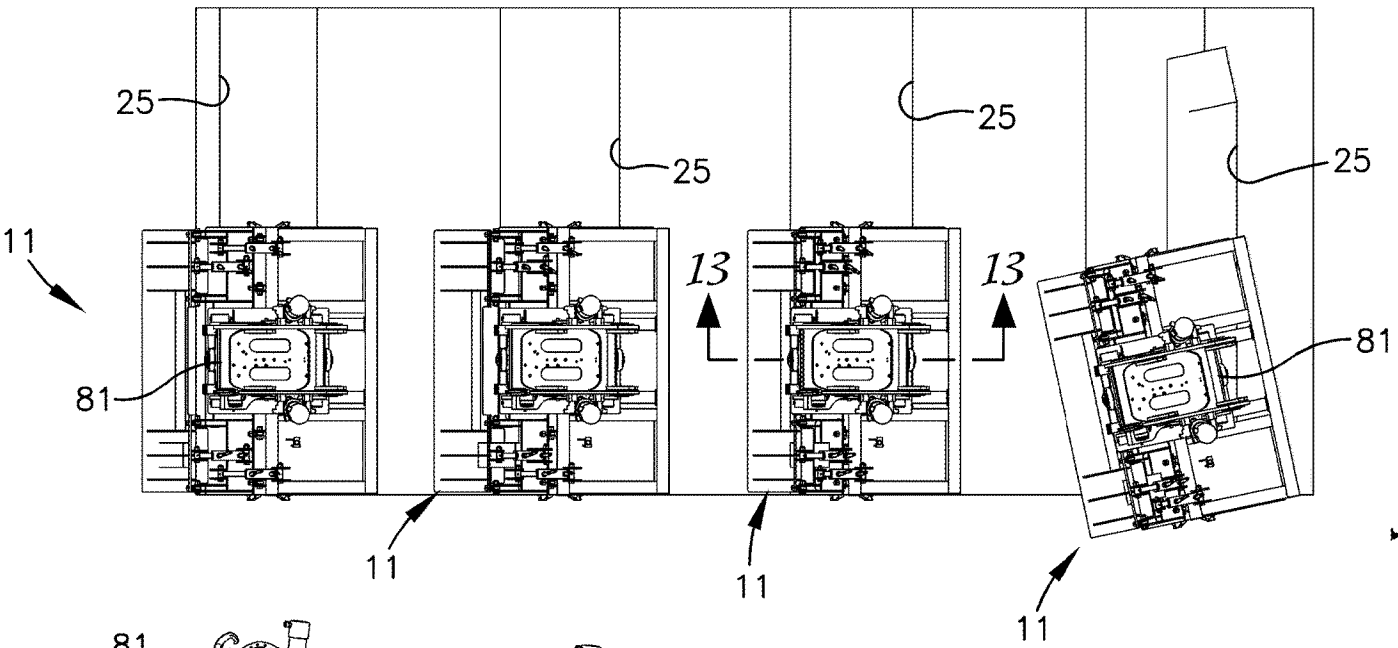
FIG. 11 is successive top plan views of the rotary ditching tool forming a ditch with a portion of the rotating tool mount shown in phantom lines.
Figure 12:
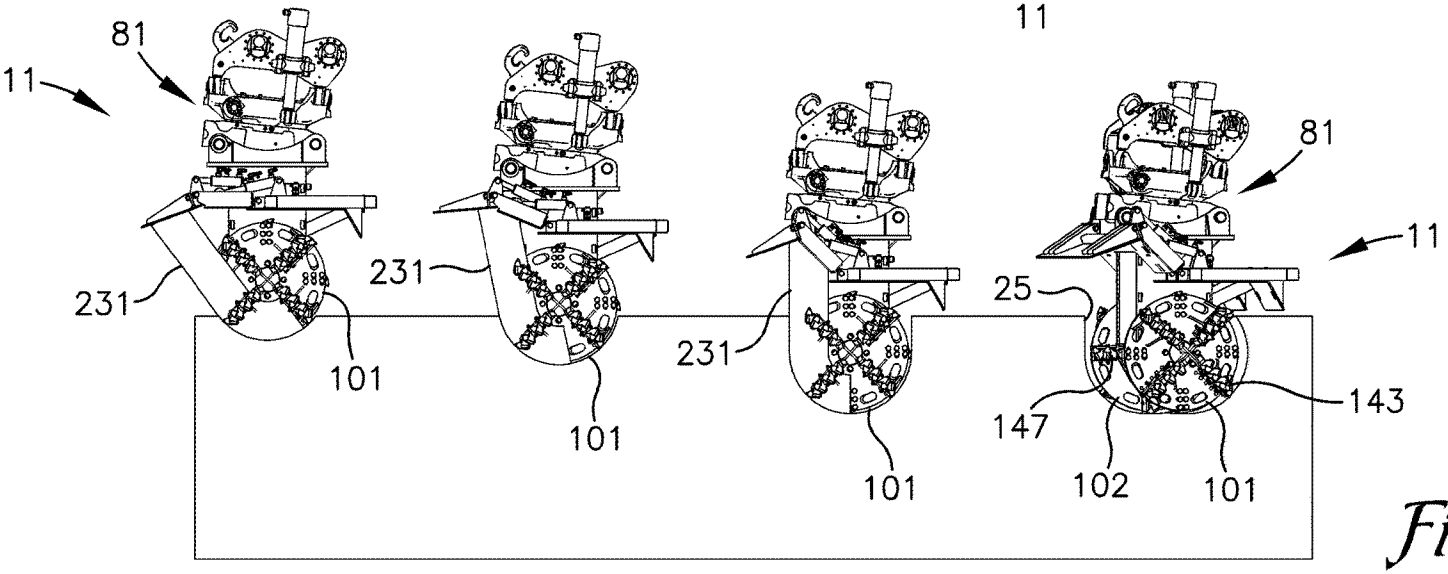
FIG. 12 is successive end elevational views of the rotary ditching tool positioned in a ditch.

Referring to FIG. 11, the rotary ditching tool 11 is shown from above (and in 4 different stages or positions of digging or cleaning out a ditch 25) with the rotary ditching tool moving down the page. FIG. 12 is a side view of the rotary ditching tool as in FIG. 11 with the rotary ditching tool moving toward the viewer. Spoils or material ejected by the excavating heads is represented by bands 231 in the first three views in FIG. 12. In the first three stages shown in FIGS. 11 and 12 the axes of rotation E (see FIGS. 7 and 8) of the excavating heads 101 and 102 are aligned with an axis through the ditch 25 being formed and with the direction of movement of the rotary ditching tool 11 by the excavator 17. With the axis of rotation E of the excavating heads 101 and 102 aligned with the direction of longitudinal movement of the rotary ditching tool 11 in forming or cleaning a ditch 25, the width of cut of the rotary ditching tool 11 corresponds to the diameter of the path of rotation of the excavating heads 101 and 102.

The fourth representation of the rotary ditching tool 11 in FIG. 11 shows the rotary ditching tool from above, with the rotary diching tool 11 rotated by rotating tool mount 81 about the axis of rotation A at an acute angle relative to the outer boom segment 72 such that the axis of rotation E of the excavating heads 101 and 102 is offset from the axis of the ditch to be formed or the direction of travel of the rotary ditching tool 11 at an acute angle. In FIGS. 11 and 12, the acute angle at which the axis of rotation E of the excavating heads 101 and 102 is offset from the axis of the ditch 25 or the direction of travel of the rotary ditching tool 11 is approximately twelve degrees. Because the first and second excavating heads 101 and 102 are offset from each other, rotation of the rotary ditching tool 11 about axis A to offset the axis of rotation E of the excavating heads 101 and 102 relative to the direction of travel of the rotary ditching tool 11 increases the width of a ditch excavated by the first and second excavating heads 101 and 102. As seen in FIG. 12, upon rotation of the rotary ditching tool 11 about axis A, to pivot the leading excavating head 101 to the right of the page in FIGS. 11 and 12, pivots the trailing excavating head 102 to the left of the page such that a portion of the trailing excavating head 102 projects to the left of the leading excavating head 101 relative to the direction of movement of the rotary ditching tool in forming the ditch 25. As the inwardly projecting excavating assemblies 147 on the trailing excavating head 102 rotate upward they engage and excavate material that was not excavated by the outwardly projecting excavating assemblies 143 on the leading excavating head 101. It is foreseen that the rotary ditching tool 11 can be rotated in either direction relative to the outer boom segment 72 and relative to the direction the rotary ditching tool is moved into the material in which a ditch 25 is to be formed to increase the cutting width of the rotary ditching tool 11. However, it may be preferred to rotate the leading excavating head 101 away from the side of the ditch 25 on which material is to be discharged so that the inwardly projecting excavating assemblies 147 on the trailing excavating head 102 extend further toward the discharge side of the ditch 25 to be formed and does not have to discharge material across the portion of the ditch formed by the leading excavating head 101.

Figure 13:
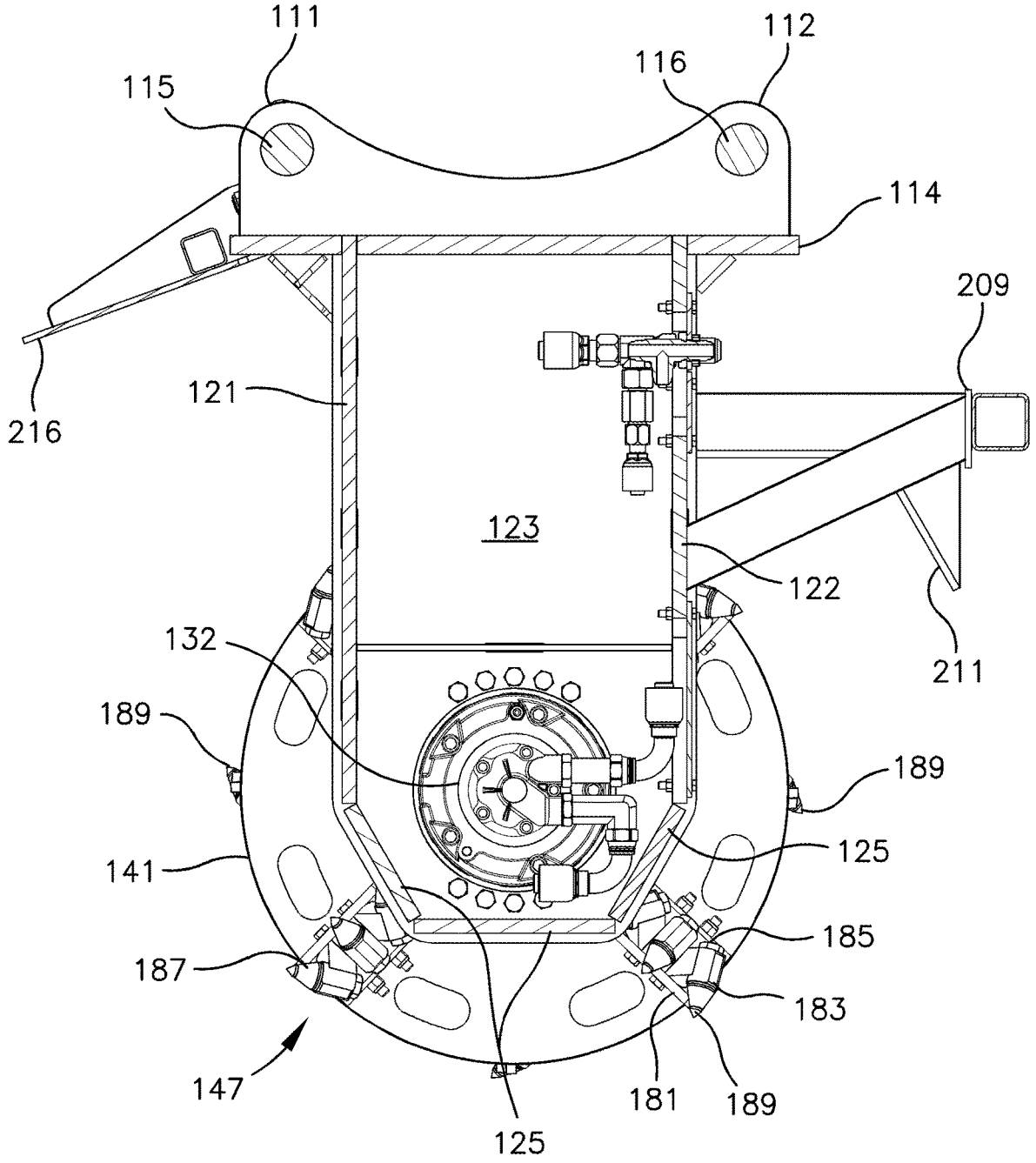
FIG. 13 is a cross-sectional view of the rotary ditching took generally taken along line 13-13 in FIG. 11.

Referring to the cross-sectional view of FIG. 13, it can be seen that a diameter of the rotor 141 of each of the first and second excavating heads 101 and 102 is greater than a width of the central support 105 generally measured as the distance from an outer face of the front panel 121 to an outer face of the rear panel 122. The rotor 141 is sized relative to the central support 105 such that at least a portion of the inwardly projecting excavating assemblies 147 extend radially outward from the central support 105 along at least a portion of a path of rotation of the inwardly projecting excavating assemblies 147 relative to the first and second sidewalls 123 and 124 of the central support 105 and a lower end of each of the first and second sidewalls 123 and 124 of the central support 105. Extension of the inwardly projecting excavating assemblies 147 outward past the central support 105 increases the excavating action of the inwardly projecting excavating assemblies 147, particularly when the rotary ditching tool 11 is rotated about axis A.

It is to be understood that while certain forms of the present invention have been illustrated and described herein, it is not to be limited to the specific forms or arrangement of parts described and shown.

What is claimed and desired to be secured by Letters Patent is as follows:

1. A ditching attachment for a tool manipulating arm, the ditching attachment comprising:

first and second excavating heads rotatably mounted in spaced relation on first and second sides of a central support, the first excavating head rotating about a first excavating head axis and the second excavating head rotating about a second excavating head axis; and a rotating mount including a first portion, releasably connectable to the manipulating arm and a second portion releasably connectable to the central support, the second portion of the rotating mount, rotatable relative to the first portion about a mount axis extending perpendicular to the first excavating head axis and the second excavating head axis;

wherein the second portion of the rotating mount is selectively rotatable about the mount axis to rotate the first and second excavating heads from a first orientation in which the axes of rotation of the first and second excavating heads extend parallel to a direction of movement of the rotary ditching tool relative to the ground in forming a ditch, to a second orientation in which the axes of rotation of the first and second excavating heads are offset at an acute angle from the direction of movement of the rotary ditching tool relative to ground to increase an excavating width of the first and second excavating heads in the direction of movement of the rotary ditching tool relative to the ground.

2. The ditching attachment as in claim 1 wherein the first excavating head axis is aligned with the second excavating head axis.

3. The ditching attachment as in claim 1 further comprising a first motor mounted on the first side of the central support and a second motor mounted on the second side of the central support, the first motor rotatingly coupled to the first excavating head and the second motor rotatingly coupled to the second excavating head.

4. The ditching attachment as in claim 3 wherein the first and second motors rotate the first and second excavating heads respectively in the same direction when viewed from one end of the ditching attachment.

5. The ditching attachment as in claim 1 wherein each of the first and second excavating heads includes:

a rotor having a plurality of outwardly projecting excavating assemblies connected to an outer face thereof and a plurality of inwardly projecting excavating assemblies connected to an inner face thereof, wherein the inner face of each rotor faces toward the central support and the outer face of each rotor faces away from the central support.

6. The ditching attachment as in claim 5 wherein:

each of the plurality of outwardly projecting excavating assemblies connected to the outer face of the rotor of each of the first and second excavating heads comprises a plurality of outwardly projecting excavating bits;

each of the plurality of inwardly projecting excavating assemblies connected to the inner face of the rotor of each of the first and second excavating heads comprises at least one inwardly projecting excavating bit.

7. The ditching attachment as in claim 1 in combination with a material handling machine adapted for traversing along a pair of sidewalls of at least one open top rail car, the material handling machine comprising a power and control unit to which the tool manipulating arm is attached, the power and control unit is rotatably mounted to an undercarriage supported on at least two rolling supports configured to ride on top of the pair of sidewalls of the at least one open top rail car.

8. The ditching attachment as in claim 1 in combination with a material handling machine adapted for traversing along first and second rails extending across the tops of first and second sidewalls of at least one open top rail car, the material handling machine comprising a power and control unit to which the tool manipulating arm is attached, the power and control unit is rotatably mounted to an undercarriage supported on first and second sets of flanged wheels configured to ride on top of the first and second rails respectively of the at least one open top rail car.

9. The ditching attachment as in claim 1, wherein the releasable connections of the first portion and the second portion comprise one or more pins or quick connection components for connecting and disconnecting the rotating mount from the manipulation arm and the central support from the second portion.

10. The rotating mount as in claim 1, wherein:

the first portion further comprises an upper mounting section which is releasably connectable to the manipulating arm and an intermediate rotating section which is pivotably connected to the upper mounting section along a tilt axis; and the second portion is rotatable relative to the first portion about a mount axis extending substantially perpendicular to the first excavating head axis, and the second excavating head axis, and the tilt axis.

11. A ditching attachment for a tool manipulating arm, the ditching attachment comprising:

first and second excavating heads rotatably mounted in spaced relation on first and second sides of a central support, the first excavating head rotating about a first excavating head axis and the second excavating head rotating about a second excavating head axis, wherein each of the first and second excavating heads includes a rotor having a plurality of outwardly projecting excavating assemblies connected to an outer face thereof and a plurality of inwardly projecting excavating assemblies connected to an inner face thereof, wherein the inner face of each rotor faces toward the central support and the outer face of each rotor faces away from the central support, and wherein a diameter of the rotor of each of the first and second excavating heads is greater than a width of the central support and wherein at least a portion of the inwardly projecting excavating assemblies extend radially outward from the central support along at least a portion of a path of rotation of the inwardly projecting excavating assemblies relative to the first and second sides of the central support and a lower end of each of the first and second sides of the central support; and a rotating mount including a first portion, releasably connectable to the manipulating arm and a second portion releasably connectable to the central support, the second portion of the rotating mount, rotatable relative to the first portion about a mount axis extending perpendicular to the first excavating head axis and the second excavating head axis.

12. A ditching attachment for a tool manipulating arm, the ditching attachment comprising:

first and second excavating heads rotatably mounted in spaced relation on first and second sides of a central support, the first excavating head rotating about a first excavating head axis and the second excavating head rotating about a second excavating head axis, wherein each of the first and second excavating heads includes a rotor having a plurality of outwardly projecting excavating assemblies connected to an outer face thereof and a plurality of inwardly projecting excavating assemblies connected to an inner face thereof, wherein the inner face of each rotor faces toward the central support and the outer face of each rotor faces away from the central support, and wherein each outwardly projecting excavating assembly comprises a base plate secured to the outer face of the rotor and extending radially outward relative thereto with an outer edge of the base plate sloping rearward and outward toward an outer edge of the rotor and a plurality of excavating bits connected to and projecting outward from the base plate; and a rotating mount including a first portion, releasably connectable to the manipulating arm and a second portion releasably connectable to the central support, the second portion of the rotating mount, rotatable relative to the first portion about a mount axis extending perpendicular to the first excavating head axis and the second excavating head axis.

13. The ditching attachment as in claim 12 wherein each of the first and second excavating heads includes:

a the plurality of outwardly projecting excavating assemblies connected to the outer face of the rotor extend radially outward across at least a portion of the outer face in arcuate spaced relationship and the plurality of inwardly projecting excavating assemblies connected to the inner face of the rotor extend radially outward across at least a portion of the inner face in arcuate spaced relationship.

14. The ditching attachment as in claim 13 wherein each outwardly projecting excavating assembly comprises a base plate secured to the outer face of the rotor and extending radially outward relative thereto with an outer edge of the base plate sloping rearward and outward toward an outer edge of the rotor and a plurality of excavating bits connected to and projecting outward from the base plate.

15. A ditching attachment for a tool manipulating arm, the ditching attachment comprising:

a rotary ditching tool including first and second excavating heads rotatably mounted in spaced relation on opposite sides of a central support, each excavating head rotating about a common, excavating head axis; and a rotating mount including a first portion releasably connectable to the manipulating arm and a second portion releasably connectable to the central support of the rotary ditching tool, the second portion of the rotating mount, rotatable relative to the first portion about a mount axis extending perpendicular to the common, excavating head axis; wherein each of the first and second excavating heads includes a rotor having a plurality of outwardly projecting excavating assemblies connected to an outer face thereof and a plurality of inwardly projecting excavating assemblies connected to an inner face thereof, wherein the inner face of each rotor faces toward the central support and the outer face of each rotor faces away from the central support;

wherein the second portion of the rotating mount is selectively rotatable about the mount axis to rotate the first and second excavating heads from a first orientation, in which the axes of rotation of the first and second excavating heads extend parallel to a direction of movement of the rotary ditching tool relative to the ground in forming a ditch, to a second orientation in which the axes of rotation of the first and second excavating heads are offset at an acute angle from the direction of movement of the rotary ditching tool relative to ground to increase an excavating width of the first and second excavating heads in the direction of movement of the rotary ditching tool relative to the ground.

16. The ditching attachment as in claim 15 further comprising a first motor mounted on the first side of the central support and a second motor mounted on the second side of the central support, the first motor rotatingly coupled to the first excavating head and the second motor rotatingly coupled to the second excavating head.

17. The ditching attachment as in claim 16 wherein the first and second motors rotate the first and second excavating heads respectively in the same direction when viewed from one end of the ditching attachment.

18. The ditching attachment as in claim 15 in combination with a material handling machine adapted for traversing along a pair of sidewalls of at least one open top rail car, the material handling machine comprising a power and control unit to which the tool manipulating arm is attached, the power and control unit is rotatably mounted to an undercarriage supported on at least two rolling supports configured to ride on top of the pair of sidewalls of the at least one open top rail car.

19. The ditching attachment as in claim 15 in combination with a material handling machine adapted for traversing along first and second rails extending across the tops of first and second sidewalls of at least one open top rail car, the material handling machine comprising a power and control unit to which the tool manipulating arm is attached, the power and control unit is rotatably mounted to an undercarriage supported on first and second sets of flanged wheels configured to ride on top of the first and second rails respectively of the at least one open top rail car.

20. The ditching attachment as in claim 15 wherein:

each of the plurality of outwardly projecting excavating assemblies connected to the outer face of the rotor of each of the first and second excavating heads comprises a plurality of outwardly projecting excavating bits;

each of the plurality of inwardly projecting excavating assemblies connected to the inner face of the rotor of each of the first and second excavating heads comprises at least one inwardly projecting excavating bit.

21. A ditching attachment for a tool manipulating arm, the ditching attachment comprising:

a rotary ditching tool including first and second excavating heads rotatably mounted in spaced relation on opposite sides of a central support, each excavating head rotating about a common, excavating head axis; and a rotating mount including a first portion releasably connectable to the manipulating arm and a second portion releasably connectable to the central support of the rotary ditching tool, the second portion of the rotating mount, rotatable relative to the first portion about a mount axis extending perpendicular to the common, excavating head axis; wherein each of the first and second excavating heads includes a rotor having a plurality of outwardly projecting excavating assemblies connected to an outer face thereof and a plurality of inwardly projecting excavating assemblies connected to an inner face thereof, wherein the inner face of each rotor faces toward the central support and the outer face of each rotor faces away from the central support; and wherein each of the plurality of outwardly projecting excavating assemblies comprises a base plate secured to the outer face of the rotor and extending radially outward relative thereto with an outer edge of the base plate sloping outward toward an outer edge of the rotor and a plurality of excavating bits connected to and projecting outward from the base plate.

22. A ditching attachment for a tool manipulating arm, the ditching attachment comprising:

a rotary ditching tool including first and second excavating heads rotatably mounted in spaced relation on opposite sides of a central support, each excavating head rotating about a common, excavating head axis; and a rotating mount including a first portion releasably connectable to the manipulating arm and a second portion releasably connectable to the central support of the rotary ditching tool, the second portion of the rotating mount, rotatable relative to the first portion about a mount axis extending perpendicular to the common, excavating head axis; wherein each of the first and second excavating heads includes a rotor having a plurality of outwardly projecting excavating assemblies connected to an outer face thereof and a plurality of inwardly projecting excavating assemblies connected to an inner face thereof, wherein the inner face of each rotor faces toward the central support and the outer face of each rotor faces away from the central support; and wherein a diameter of the rotor of each of the first and second excavating heads is greater than a width of the central support and wherein at least a portion of the inwardly projecting excavating assemblies extend radially outward from the central support along at least a portion of a path of rotation of the inwardly projecting excavating assemblies relative to the first and second sides of the central support and a lower end of each of the first and second sides of the central support.

* * * * *